US007247210B2

(12) United States Patent
Staub et al.

(10) Patent No.: US 7,247,210 B2
(45) Date of Patent: Jul. 24, 2007

(54) METHODS FOR TREATING CIP EQUIPMENT AND EQUIPMENT FOR TREATING CIP EQUIPMENT

(75) Inventors: Richard K. Staub, Lakeville, MN (US); Mark R. Altier, St. Paul, MN (US); Paul F. Schacht, Oakdale, MN (US); Robert D. P. Hei, Baldwin, WI (US); Gabriel M. Miller, Lodi, WI (US); Thomas L. Harris, Eden Prairie, MN (US); Peter J. Fernholz, Burnsville, MN (US)

(73) Assignee: Ecolab Inc., St. Paul, MN (US)

( * ) Notice: Subject to any disclaimer, the term of this patent is extended or adjusted under 35 U.S.C. 154(b) by 378 days.

(21) Appl. No.: 10/784,540

(22) Filed: Feb. 23, 2004

(65) Prior Publication Data

US 2005/0183744 A1 Aug. 25, 2005

(51) Int. Cl.
*B08B 3/02* (2006.01)

(52) U.S. Cl. ..... 134/36; 134/22.1; 134/22.12; 134/22.18; 134/31; 134/37

(58) Field of Classification Search ..... 134/26, 134/31, 37, 22.1, 25.3, 22.12, 22.18, 34, 134/36

See application file for complete search history.

(56) References Cited

U.S. PATENT DOCUMENTS 3,794,169 A 2/1974 Sisk et al.
3,802,390 A 4/1974 Blair et al.
3,840,402 A 10/1974 Tobin, III
3,912,624 A 10/1975 Jennings
3,992,301 A 11/1976 Shippey et al.
4,153,545 A 5/1979 Zwack et al.
4,222,871 A 9/1980 Lefeuvre
4,224,963 A 9/1980 Stahle
4,244,820 A 1/1981 Hauk et al.
4,299,121 A 11/1981 Asayama et al.
4,409,088 A 10/1983 Kanno et al.

(Continued)

FOREIGN PATENT DOCUMENTS

AU 8934601 11/1989

(Continued)

OTHER PUBLICATIONS

"AirFlush® processing: Minimise chemicals by AIR-enhanced membrane cleaning," http://www.xflow.nl/english/concepten/airflush.html, 3 pages (Date Printed Feb. 15, 2002).

(Continued)

*Primary Examiner*—Michael Barr
*Assistant Examiner*—Saeed Chaudhry
(74) *Attorney, Agent, or Firm*—Andrew D. Sorensen; Anneliese S. Mayer

(57) ABSTRACT

A method for treating CIP equipment is provided according to the present invention. The CIP equipment includes process equipment. The method includes steps of treating the CIP equipment with a multiple phase treating composition comprising a treating liquid phase and a treating gaseous phase and rinsing the CIP equipment with a multiple phase rinsing composition comprising a rinsing liquid phase and a rinsing gaseous phase.

22 Claims, 3 Drawing Sheets

U.S. PATENT DOCUMENTS

| | | | | |
|---|---|---|---|---|
| 4,482,514 | A | 11/1984 | Schindler et al. | |
| 4,624,760 | A | 11/1986 | Pottinger et al. | |
| 4,740,308 | A | 4/1988 | Fremont et al. | |
| 4,792,401 | A | 12/1988 | Truex et al. | |
| 4,801,375 | A | 1/1989 | Padilla | |
| 4,871,683 | A | 10/1989 | Harris et al. | |
| 4,923,609 | A | 5/1990 | Jardine | |
| 4,943,374 | A | 7/1990 | Heininger et al. | |
| 5,028,329 | A | 7/1991 | Drioli et al. | |
| 5,039,324 | A | 8/1991 | Goldberg | |
| 5,147,309 | A | 9/1992 | Hemmerich et al. | |
| 5,169,412 | A | 12/1992 | Prasad et al. | |
| 5,171,446 | A | 12/1992 | Shen | |
| 5,221,477 | A | 6/1993 | Melcher et al. | |
| 5,242,046 | A | 9/1993 | Bailey | |
| 5,395,429 | A | 3/1995 | Sutsko et al. | |
| 5,456,843 | A | 10/1995 | Koenhen | |
| 5,560,828 | A | 10/1996 | Wenten et al. | |
| 5,605,628 | A | 2/1997 | Davidson et al. | |
| 5,690,830 | A | 11/1997 | Ohtani et al. | |
| 5,801,051 | A | 9/1998 | Kiefer et al. | |
| 6,004,374 | A | 12/1999 | Rao et al. | |
| 6,027,572 | A | 2/2000 | Labib et al. | |
| 6,071,356 | A | 6/2000 | Olsen | |
| 6,089,242 | A * | 7/2000 | Buck | 134/57 R |
| 6,112,908 | A | 9/2000 | Michaels | |
| 6,158,721 | A | 12/2000 | Katou et al. | |
| 6,161,250 | A | 12/2000 | Young et al. | |
| 6,161,558 | A * | 12/2000 | Franks et al. | 134/57 R |
| 6,174,351 | B1 | 1/2001 | McDowell et al. | |
| 6,197,203 | B1 | 3/2001 | Ishida et al. | |
| 6,197,739 | B1 | 3/2001 | Oakes et al. | |
| 6,214,231 | B1 | 4/2001 | Cote et al. | |
| 6,261,457 | B1 | 7/2001 | Wenthold et al. | |
| 6,280,626 | B1 | 8/2001 | Miyashita et al. | |
| 6,288,222 | B1 | 9/2001 | Roth et al. | |
| 6,326,340 | B1 | 12/2001 | Labib et al. | |
| 6,351,864 | B1 | 3/2002 | Karafa et al. | |
| 6,355,173 | B1 | 3/2002 | den Bieman et al. | |
| 6,387,189 | B1 | 5/2002 | Gröschl et al. | |
| 6,402,956 | B1 | 6/2002 | Andou et al. | |
| 6,454,871 | B1 | 9/2002 | Labib et al. | |
| 6,485,762 | B1 | 11/2002 | Rizvi et al. | |
| 6,499,606 | B1 | 12/2002 | Grangeon et al. | |
| 6,515,115 | B1 | 2/2003 | Kwant et al. | |
| 6,524,481 | B2 | 2/2003 | Zha et al. | |
| 6,619,302 | B2 | 9/2003 | Labib et al. | |
| 6,767,408 | B2 * | 7/2004 | Kenowski et al. | 134/18 |
| 2002/0112743 | A1 | 8/2002 | Tabani et al. | |
| 2004/0007255 | A1 | 1/2004 | Labib et al. | |

FOREIGN PATENT DOCUMENTS

| | | | |
|---|---|---|---|
| CN | 1221648 | | 7/1999 |
| DE | 2818127 | A1 | 11/1978 |
| DE | 3818919 | | 12/1989 |
| DE | 4101045 | | 8/1991 |
| DE | 4109732 | | 10/1992 |
| DE | 4226673 | | 2/1994 |
| DE | 19724172 | A1 | 12/1998 |
| DE | 19730441 | A1 | 1/1999 |
| DE | 10004863 | A1 | 2/2001 |
| DE | 19920269 | A1 | 3/2001 |
| EP | 301597 | | 2/1989 |
| EP | 0 490 117 | A1 | 6/1992 |
| EP | 0 160 014 | B1 | 1/1993 |
| EP | 526372 | A1 | 2/1993 |
| EP | 645174 | A1 | 3/1995 |
| EP | 0 970 922 | A2 | 1/2000 |
| FR | 2707520 | A1 | 1/1995 |
| FR | 2727787 | A1 | 6/1996 |
| JP | 51071880 | A2 | 6/1976 |
| JP | 52058078 | A2 | 5/1977 |
| JP | 53108882 | | 9/1978 |
| JP | 54067574 | | 5/1979 |
| JP | 55049887 | B4 | 12/1980 |
| JP | 56024006 | | 3/1981 |
| JP | 56015924 | B4 | 4/1981 |
| JP | 61153104 | A2 | 7/1986 |
| JP | 61192309 | A2 | 8/1986 |
| JP | 63104610 | A2 | 5/1988 |
| JP | 63126513 | A2 | 5/1988 |
| JP | 63147506 | | 6/1988 |
| JP | 01104309 | | 4/1989 |
| JP | 01262903 | | 10/1989 |
| JP | 01262904 | | 10/1989 |
| JP | 02183749 | | 7/1990 |
| JP | 03042018 | | 2/1991 |
| JP | 04317726 | | 11/1992 |
| JP | 05277345 | | 10/1993 |
| JP | 06023246 | | 2/1994 |
| JP | 07000770 | A2 | 1/1995 |
| JP | 07246320 | A2 | 9/1995 |
| JP | 07313851 | A2 | 12/1995 |
| JP | 09108670 | A2 | 4/1997 |
| JP | 09117647 | | 5/1997 |
| JP | 09262442 | A2 | 10/1997 |
| JP | 10052377 | A2 | 2/1998 |
| JP | 10057957 | A2 | 3/1998 |
| JP | 10085562 | A2 | 4/1998 |
| JP | 11057415 | | 3/1999 |
| JP | 11077042 | A2 | 3/1999 |
| JP | 11104636 | A2 | 4/1999 |
| JP | 11165186 | A2 | 6/1999 |
| JP | 11169684 | | 6/1999 |
| JP | 11197685 | A2 | 7/1999 |
| JP | 11256193 | | 9/1999 |
| JP | 11309346 | A2 | 11/1999 |
| JP | 2000000598 | | 1/2000 |
| JP | 2000051670 | A2 | 2/2000 |
| JP | 2000061273 | | 2/2000 |
| JP | 2000325758 | A2 | 11/2000 |
| JP | 2001038164 | A2 | 2/2001 |
| JP | 2001079366 | | 3/2001 |
| JP | 2001104760 | | 4/2001 |
| JP | 2001145676 | | 5/2001 |
| JP | 2001205055 | | 7/2001 |
| JP | 2001259384 | | 9/2001 |
| KR | 2001018168 | | 3/2001 |
| RU | 2033579 | | 4/1995 |
| RU | 2046080 | | 10/1995 |
| SU | 743691 | | 7/1980 |
| SU | 948386 | | 8/1982 |
| SU | 1350434 | | 11/1987 |
| SU | 1532099 | | 12/1989 |
| SU | 1701358 | A1 | 12/1991 |
| WO | WO 9517526 | A1 | 6/1995 |
| WO | WO 9733832 | A1 | 9/1997 |
| WO | WO 2000018498 | A1 | 4/2000 |

OTHER PUBLICATIONS

Allen, V. et al., "Test program for physical cleaning and fouling prevention in reverse osmosis systems," *Report*, CEL-CR-78.010, Order AD-A055624 (1978) (1 page abstract).

Balek, W., "Overview of Food Safety Regulation in the United States," *International Sanitary Supply Association*, pp. 1-8 (Mar. 30, 2001).

Bellara, S. et al., "Gas Sparging to enhance permeate flux in ultrafiltration using hollow fibre membranes," *Journal of Membrane Science*, vol. 121, No. 2, pp. 175-184 (Dec. 11, 1996) (1 page abstract).

Bellara, S. et al., "Flux enhancement in hollow fiber membrane systems," *IChemE Res. Event, Eur. Conf. Young Res. Chem. Eng., 2nd*, vol. 1, pp. 310-312 (1996) (1 page abstract).

Bodzek, M., "Membrane techniques in air cleaning," *Pol. J. Environ. Stud.*, vol. 9, No. 1, pp. 1-12 (2000) (1 page abstract).

Bouhabila, E. et al., "Microfiltration of activated slude using submerged membrane with air bubbling (application to wastewater treatment)," *Desalination*, vol. 118, Nos. 1-3, pp. 315-322 (1998) (1 page abstract).

Bouhabila, E. et al., "Fouling characterization in membrane bioreactors," *Separation and Purification Technology*, vol. 22 and 23, Nos. 1-3, pp. 123-132 (2001) (1 page abstract).

Bourcier, W. et al., "Pretreatment of oil field and mine waste waters for reverse osmosis," *Environ. Sci. Res.*, vol. 52, pp. 509-519 (1996) (1 page abstract).

Cabassud, C. et al., "Flux enhancement by a tangential gas flow in ultrafiltration hollow fibers for drinking water production," *Proc.-World Filrt. Congr., 7th*, vol. 2, pp. 496-500 (1996) (1 page abstract).

Cabassud, C. et al., "How slug flow can improve ultrafiltration flux in organic hollow fibres," *Journal of Membrane Science*, vol. 128, pp. 93-101 (1997).

Cabassud, C. et al., "Air sparging in ultrafiltration hollow fibers: relationship between flux enhancement, cake characteristics and hydrodynamic parameters," *Journal of Membrane Science*, vol. 181, No. 1, pp. 57-69 (Jan. 15, 2001) (1 page abstract).

Chakma, A., "Separation of CO2 and SO2 from flue gas streams by liquid membranes," *Energy Convers. Manage.*, vol. 36, Nos. 6-9, pp. 405-410 (1995) (1 page abstract).

Chang, S. et al., "Characteristics of microfiltration of Suspensions with inter-fiber two-phase flow," *Journal of Chemical Technology & Biotechnology*, vol. 75, No. 7, pp. 533-540 (2000) (1 page abstract).

Cheng, T. et al., "Effects of gas slugs and inclination angle on the ultrafiltration flux in tubular membrane module," *J. Membr. Sci.*, vol. 158, Nos. 1-2, pp. 223-234 (1999) (1 page abstract).

Cheng, T., "Influence of inclination on gas-sparged crossflow ultrafiltration through an inorganic tubular membrane," *Journal of Membrane Science*, vol. 196, No. 1, pp. 103-110 (2002) (1 page abstract).

Chevyan, M., "Introduction. Definition and Classification of Membrane Separation Processes," *Ultrafiltration and Microfiltration Handbook*, 22 pages (1998).

Cui, Z. et al., "Flux enhancements with gas sparging in downwards crossflow ultrafiltration: performance and mechanism," *J. Membr. Sci.*, vol. 117, Nos. 1-2, pp. 109-116 (1996) (1 page abstract).

Cui, Z. et al., "Airlift crossflow membrane filtration—a feasibility study with dextran ultrafiltration," *Journal of Membrane Science*, vol. 128, No. 1, pp. 83-91 (May 28, 1997) (1 page abstract).

Cui, Z. et al., "Water Treatment with Membranes and Membrane Bioreactors," http://www.eng.ox.ac.uk.World/Research/Summary/B-Biotech.html, 1 page (May 17, 2002).

"Desal™ Membrane Products, Food & Dairy Sanitary Ultrafiltration PES—10,000 MWCO," *Osmonics*, 2 pages, date unknown.

"Desal® Membrane Products, Dairy Processing Sanitary Ultrafiltration PES—10,000 MWCO," http://www.osmonics.com/Literature/Literature.asp?G=31, 2 pages (Date Printed Mar. 12, 2003).

Duin, O. et al., "Direct nanofiltration or ultrafiltration of WWTP effluent?," *Proceedings of the Conference on Membranes in Drinking and Industrial Water Production*, vol. 2, pp. 105-112 (Oct. 2000).

Dunham, S. et al., "Membrane Cleaning Under the Microscope Successful Cleaning Means Knowing the Foulant," *Water Technology*, 4 pages (Sep. 1995).

Eltron Research, Inc., "In Situ Electrolytic System for Ultrafiltration Membrane Cleaning," (1 page abstract).

Fazel, M. et al., "A statistical review of 150 membrane autopsies," 7 pages, date unknown.

Gotham, S. et al., "Model Studies of Food Fouling," pp. 1-13, date unknown.

Ghosh, R. et al., "Mass transfer in gas-sparged ultrafiltration: upward slug flow in tubular membranes," *Journal of Membrane Science*, vol. 162, Nos. 1-2, pp. 91-102 (Sep. 1, 1999) (1 page abstract).

Hong, S. et al., "Assessing pathogen removal efficiency of microfiltration by monitoring membrane integrity," *Water Science & Technology: Water Supply*, vol. 1, No. 4, pp. 43-48 (2001) (1 page abstract).

Huang, J. et al., "Pilot-plant study of a high recovery membrane filtration process for drinking water treatment," *Water Science and Technology*, vol. 41, Nos. 10-11, pp. 77-84 (2000) (1 page abstract).

Imasaka, T. et al., "Application of gas-liquid two-phase cross-flow filtration to pilot-scale methane fermentation," *Drying Technol.*, vol. 11, No. 4, pp. 769-785 (1993) (1 page abstract).

Jacangelo, J. et al., "The membrane treatment," *Civil Engineering*, 7 pages (Sep. 1998) http://www.pubs.asce.org/ceonline/sepfeat.html.

Jenkins, S. et al., "Fluorometric analysis of the uniformity of deposition on cassette membrane filters," *Appl. Occup. Environ. Hyg.*, vol. 7, No. 10, pp. 665-671 (1992) (1 page abstract).

Kennedy, M. et al., "Improving the performance of dead-end ultrafiltration systems: comparing air and water flushing," *Water Science and Technology: Water Supply*, vol. 1, No. 5/6, pp. 97-106 (2001).

Klein, G. et al., "Fouling in Membrane Apparatus: The Mechanisms of Particle Deposition," *Trans IChemE*, vol. 77, Part C, pp. 119-126 (Jun. 1999).

Laborie, S. et al., "Flux enhancement by a continuous tangential gas flow in ultrafiltration hollow fibers for drinnking water production: effects of slug flow on cake structure," *Filtr. Sep.*, vol. 34, No. 8, pp. 887-891 (1997) (1 page abstract).

Laborie, S. et al., "Fouling control by air sparging inside hollowing fiber membranes—effects on energy consumption," *Desalination*, vol. 118, No. 1-3, pp. 189-196 (1998) (1 page abstract).

Laborie, S. et al., "Characterisation of gas-liquid two-phase flow inside capillaries," *Chemical Engineering Science*, vol. 54, No. 23, pp. 5723-5735 (Dec. 1999) (1 page abstract).

Laitinen, N. et al., "Effect of filtration conditions and backflushing on ceramic membrane ultrafiltration of board industry wastewaters," *Separation and Purification Technology*, vol. 24, Nos. 1-2, pp. 319-328 (2001) (1 page abstract).

Makardij, A. et al,. "Microfiltration and ultrafiltration of milk: Some aspects of fouling and cleaning," *Trans IChemE*, vol. 77, Part C, pp. 107-113 (Jun. 1999).

"Market Engineering Measurement Analysis of the Total Ultrafiltration, Nanofiltration, and Reverse Osmosis Membrane Elements Market," *U.S. Ultrafiltration, Nanofiltration, and Reverse Osmosis Filter Element Markets 5318-15*, pp. 3-1-3-6 (2000).

Mercier, M. et al., "How slug flow can enhance the ultrafiltration flux in mineral tubular membranes," *Journal of Membrane Science*, vol. 128, pp. 103-113 (1997).

Mercier, M. et al., "Membrane bioreactors in fermentation process—two-phase flow may be a solution to enhance crossflow filtration flux," *BHR Group Conf. Ser. Publ.*, vol. 25, pp. 331-348 (1997) (1 page abstract).

Mercier, M. et al., "Yeast suspension filtration: flux enhancement using an upward gas/liquid slug flow—application to continuous alcoholic fermentation with cell recycle," *Biotechnol. Bioeng.*, vol. 58, No. 1, pp. 47-57 (1998) (1 page abstract).

Mercier-Bonin, M. et al., "Influence of a gas/liquid two-phase flow on the ultrafiltration and microfiltration performances: case of a ceramic flat sheet membrane," *Journal of Membrane Science*, vol. 180, No. 1, pp. 93-102 (2000) (1 page abstract).

Mercier-Bonin, M. et al., "Hydrodynamics of slug flow applied to cross-flow filtration in narrow tubes," *AIChE J.* vol. 46, No. 3, pp. 476-488 (2000) (1 page abstract).

Mercier-Bonin, M. et al., "How unsteady filtration conditions can improve the process efficiency during cell cultures in membrane bioreactors," *Separation and Purification Technology*, vol. 22 and 23, No. 1-3, pp. 601-615 (2001) (1 page abstract).

Mikulasek, P. et al., "The use of flux enhancement methods for high flux cross-flow membrane microfiltration systems," *Chemical and Biochemical Engineering Quarterly*, vol. 14, No. 4, pp. 117-123 (2000) (1 page abstract).

Mikulasek, P. et al., "Flux enhancement by gas-liquid two-phase flow for crossflow microfiltration in a tubular ceramic membrane," *J. Filtr. Soc.*, vol. 2, No. 1, pp. 20-26 (2001) (1 page abstract).

Nordman-Montelius, M. et al., "Analyses of Raw Milk Deposits on Non-Heated Polymer Surfaces," pp. 276-285, date unknown.

Paul, D. et al., "Membrane separation processes for clean production," *Environ. Prog.*, vol. 17, No. 3, pp. 137-141 (1998) (1 page abstract).

Paulson, D., Membranes, the Finest Filtration, *Filtration News*, http://www.osmonics.com/products/Page698.htm, 9 pages (Jul. 1, 1995).

Princeton Trade & Technology Inc., "Cleaners for Wastewater Ultrafiltration Membranes," (1 page abstract).

Rogut, J., "Design and development of high performance gas-liquid membrane contactors for SO2 and NOx removal from flue gases," *Proc. Int. Tech. Conf. Coal Util. Fuel Syst.*, vol. 21, pp. 87-98 (1996) (1 page abstract).

Roorda, J. et al., "Understanding membrane fouling in ultrafiltration of WWTP-effluent," *Water Science and Technology*, vol. 41, No. 10-11, pp. 345-353 (2000).

Ruiz, J. et al., "Solid aerosol removal using ceramic filters," *Separation and Purification Technology*, vol. 19, No. 3, pp. 221-227 (Jul. 1, 2000) (1 page abstract).

Sandu, C. et al., "Fouling of Heating Surfaces—Chemical Reaction Fouling Due to Milk," pp. 122-167, date unknown.

Scott, K. et al., "Intensified membrane filtration with corrugated membranes," *Journal of Membrane Science*, vol. 173, No. 1, pp. 1-16 (2000) (1 page abstract).

Serra, C. et al., "Use of air sparging to improve backwash efficiency in hollow-fiber modules," *Journal of Membrane Science*, vol. 161, No. 1-2, pp. 95-113 (2002) (1 page abstract).

Shimizu, Y. et al., "Filtration characteristics of hollow fiber microfiltration membranes used in membrane bioreactor for domestic wastewater treatment," *Water Res.*, vol. 30, No. 10, pp. 2385-2392 (1996) (1 page abstract).

"Standard Test Methods for Pore Size Characteristics of Membrane Filters by Bubble Point and Mean Flow Pore Test," pp. 1-7, date unknown.

"The Environmental Technology Centre," http://www.nottingham.ac.uk/~enzetc/technology/cmf.htm, 2 pages (Date Printed Mar. 21, 2003).

"The Environmental Technology Verification Program. ETV Joint Verification Statement," *U.S. Environmental Protection Agency*, pp. VS-i-VS-vi (Sep. 2000).

"U-Tube Reactor and Ultrafiltration Membrane," Water Pollution Control Technology in Japan, Nightoil Treatment, 3 pages (Date Printed Jun. 21, 2002) http://nett21.unep.or.jp/CTT_DATA/WATER/WATER_3/html/Water-165.html.

Väisänen, P. et al., "Treatment of UF membranes with simple and formulated cleaning agents," *Trans IChemE*, vol. 80, Part C, pp. 98-108 (Jun. 2002).

Verberk, J. et al., Combined air-water flush in dead-end ultrafiltration, *Proceedings of the Conference on Membranes in Drinking and Industrial Water Production*, vol. 2, pp. 655-663 (Oct. 2000).

Verberk, J. et al., "Combined air-water flush in dead-end ultrafiltration," *Water Science and Technology: Water Supply*, vol. 1, No. 5/6, pp. 393-402 (2001).

Verberk, J., "Air-water cleaning for micro and ultrafiltration," http://www.gezondheidstechniek.tudelft.nl\verberk.htm, 4 pages (Apr. 16, 2002).

Verberk, J, et al., "Hydraulic distribution of water and air over a membrane module using AirFlush®," *Water Science and Technology: Water Supply*, vol. 2, No. 2, pp. 297-304 (2002).

Verberk, J. et al., "Combined air-water flush in dead-end ultrafiltration," *TU Delft*, 1 page, date unknown.

Wang, Z. et al., "Characteristics of dextran and BSA fouling of PS membrane and its microscopic mechanism," *Shuichuli Jishu*, vol. 26, No. 5, pp. 273-276 (2000) (1 page abstract).

* cited by examiner

METHODS FOR TREATING CIP EQUIPMENT AND EQUIPMENT FOR TREATING CIP EQUIPMENT

FIELD OF THE INVENTION

The invention relates to a method of treating clean-in-place (CIP) equipment and equipment for treating clean-in-place equipment. The method utilizes various gas/liquid ratios to optimize the treatment of the CIP equipment. The method for treating the CIP equipment includes the use of a multiple phase composition for the treatment of the CIP equipment.

BACKGROUND OF THE INVENTION

The use of a two-phase liquid/gas stream to clean pipelines is disclosed in European Patent Application 0 490 117 A1 to Kuebler that was published on Jun. 17, 1992 as an alternative to conventional clean-in-place (CIP) techniques in order to reduce the amount of chemicals used. Kuebler describes cleaning pipelines using a two-phase liquid/gas stream and a reduction in throughput of the cleaning liquid by several orders of magnitude relative to conventional clean-in-place techniques.

Additional publications describing mixed phased flow include, for example, U.S. Pat. No. 6,326,340 to Labib et al.; U.S. Pat. No. 6,454,871 to Labib et al.; and U.S. Pat. No. 6,027,572 to Labib et al.

SUMMARY OF THE INVENTION

A method for treating CIP equipment is provided according to the present invention. The CIP equipment includes process equipment. The method includes steps of treating the CIP equipment with a multiple phase treating composition comprising a treating liquid phase and a treating gaseous phase and rinsing the CIP equipment with a multiple phase rinsing composition comprising a rinsing liquid phase and a rinsing gaseous phase.

An alternative method for treating CIP equipment that includes process equipment is provided according to the invention. The method includes steps of treating the CIP equipment with a multiple phase treating composition comprising a treating liquid phase and a treating gaseous phase; rinsing the CIP equipment with a multiple phase rinsing composition comprising a rinsing liquid phase and a rinsing gaseous phase; and sanitizing the CIP equipment with a multiple phase sanitizing composition comprising a sanitizing liquid phase and a sanitizing gaseous phase.

A multiple phase CIP system for treating CIP equipment using multiple phase flow is provided according to the invention. The multiple phase CIP system includes a CIP fresh treatment tank for providing a liquid phase for a multiple phase treating composition; a forced air source for providing a gaseous phase for the multiple phase composition; and an injection port for injecting the liquid phase into the gaseous phase.

DISCUSSION OF THE INVENTION

Figure 1:
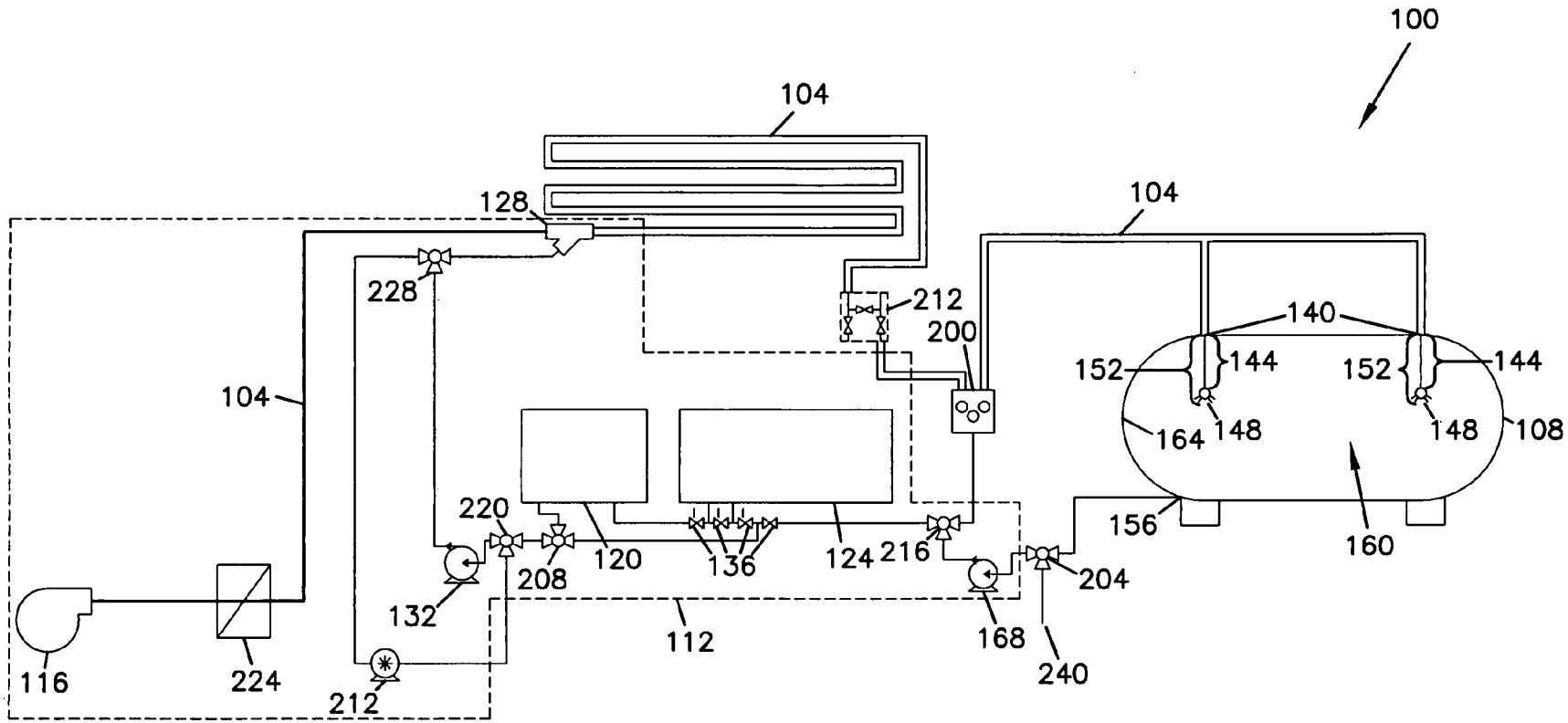
FIG. 1 is a diagram of an exemplary circuit, which is a portion of an entire processing and/or production line.

A method for treating clean-in-place (CIP) equipment using multiple phase flow and equipment for treating CIP equipment are provided according to the invention. Exemplary techniques for treating CIP equipment include cleaning, rinsing, pre-treating, flushing, soaking, and sanitizing.

The CIP equipment is generally provided within an industrial plant. The industrial plant provides the processing, the storage, and/or the production of various end products. Exemplary industries include the food industry, the beverage industry, the pharmaceutical industry, the chemical industry, and the water purification industry. In the case of the food and beverage industries, products processed by the CIP equipment include milk, whey, fruit juice, beer, wine, cheese, red meat, and poultry.

The CIP equipment generally is not dismantled because it is too labor intensive. The CIP equipment can include process equipment and flow equipment. The process equipment conducts some type of operation (e.g. heats, evaporates, separates, ferments, ages, mixes, cooks, dries, pasteurizes, etc.) on a material and/or provides storage for a material. Exemplary process equipment can include evaporators, separators, fermentation tanks, aging tanks, beer storage tanks, storage tanks, mash vessels, mixers, driers, and heat exchangers. The flow equipment provides a mechanism for transporting and/or directing the material that is processed, stored, and/or produced. Exemplary flow equipment can include delivery lines, valves, valve clusters, valve manifolds, restrictors, transfer stations, and orifices.

CIP equipment generally is treated by the use of a CIP system. The CIP system includes the equipment necessary to provide for the treatment of the CIP equipment. In a conventional CIP system, the equipment provides a single phase flow of liquid. In a multiple phase CIP system, the equipment provides a multiple phase flow.

A conventional CIP system can include a CIP fresh treatment tank or multiple CIP fresh treatment tanks, a CIP recovery tank or multiple CIP recovery tanks, a valve (e.g., valve cluster, valve manifold, and transfer station), a delivery line, a return pump, a chemical delivery system, a controller, and a high volume pump. The high volume pump provides a sufficient amount of a liquid phase to the CIP equipment to adequately treat the CIP equipment. The CIP recovery tank generally collects the liquid phase of the treating/treatment composition after it has been used to treat the CIP equipment. The liquid phase collected in the CIP recovery tank can be used as the liquid phase of a rinsing composition for the CIP equipment. The fresh or new liquid phase used for treating the CIP equipment is stored in the CIP fresh treatment tank. The valves control the route of flow of the liquid phase, the gaseous phase, and the multiple phase composition within the delivery lines. The delivery lines are used to transport the material, e.g. liquid phase, gaseous phase, and multiple phase composition. The return pump is used to pump the liquid phase from the CIP equipment back to the CIP system. The liquid phase can be recirculated through the CIP fresh treatment tank or the CIP recovery tank or both. The liquid phase pumped by the return pump can be collected by the CIP recovery tank or disposed of in a drain. The chemical delivery system delivers the chemistry that can be used in the treating composition to the CIP system. The controller controls the CIP system, e.g. opens and closes the correct valves, determines the amount of chemistry to be delivered by the chemical delivery system, etc. The conventional CIP system can optionally include a heat exchanger. The heat exchanger is used to heat the liquid phase to a desired temperature. The desired temperature can include any temperature that provides an effective liquid phase for treating the CIP equipment.

A multiple phase CIP system can include the equipment of the conventional CIP system (a CIP fresh treatment tank, a CIP recovery tank, a valve, a delivery line, a return pump, a high volume pump, a chemical delivery system, a controller, and an optional heat exchanger) with the addition of a flow restrictor, a forced air source, and an injection port. A flow restrictor, for example, an orifice plate, is required to reduce the amount of liquid phase provided by the high volume pump because the amount of the liquid phase required for multiple phase flow is less than that required for single phase flow. The flow restrictor is placed in the delivery line that transports liquid phase from the high volume pump. The flow restrictor reduces the amount of liquid phase that flows through the delivery line by restricting the size of the delivery line. A flow restrictor is a component that is generally understood by someone skilled in the art. The reduced amount of liquid phase is sufficient to adequately treat the interior surface of the CIP equipment using a multiple phase composition. The reduced amount of liquid phase is sufficient to adequately treat the CIP equipment. The forced air source can be a blower or a compressor. The forced air source provides the gaseous phase of the multiple phase treatment composition. The injection port allows for the injection of the liquid phase into the gaseous phase, which creates a multiple phase flow. The multiple phase CIP system can include more than one CIP fresh treatment tank. The multiple phase CIP system can optionally include an air filter. The air filter provides removal of unwanted contaminants or debris from the gaseous phase. The air filter is provided within a delivery line that connects the forced source with the injection port.

An alternative embodiment of the multiple phase CIP system can include a CIP fresh treatment tank, a CIP recovery tank, a valve, a delivery line, a return pump, a variable speed pump, a chemical delivery system, a controller, a forced air source, and an injection port. The variable speed pump replaces the high volume pump. Therefore, the need for a reducer is eliminated because the variable speed pump allows the amount of liquid provided by the pump to be reduced by lowering the speed of the pump. The speed of the variable speed pump can be adjusted so that the pump provides an amount of liquid phase sufficient to adequately treat the interior surface of the CIP equipment using a multiple phase composition.

Another exemplary embodiment of the multiple phase CIP system includes a low volume pump, a CIP fresh treatment tank, a CIP recovery tank, a chemical delivery system, a controller, a valve, a delivery line, a return pump, a forced air source, and an injection port. The low volume pump provides an amount of liquid phase sufficient to adequately treat the interior surface of the CIP equipment using a multiple phase composition.

Another embodiment of the multiple phase CIP system includes a low volume pump, a high volume pump, a CIP fresh treatment tank, a CIP recovery tank, a chemical delivery system, a controller, a valve, a delivery line, a return pump, a forced air source, a flow restrictor, and an injection port. The low volume pump is used to deliver an amount of liquid phase sufficient to adequately treat the interior surface of the CIP equipment using a multiple phase composition. The high volume pump is used to deliver an amount of liquid phase sufficient to treat the interior surface of the CIP equipment using a single, liquid phase. Valves direct the flow of the liquid phase in the appropriate direction depending on whether single or multiple phase flow is desired for treating the CIP equipment.

The method of treating CIP equipment using multiple phase flow can include the use of a delivery head within the process equipment, such as a storage tank. The delivery head is within the process equipment interior and delivers a sufficient amount of the liquid phase of the multiple phase composition to the interior surface of the process equipment. The delivery head can include a spray arm and a spray device. The spray arm is a cylindrical piece of metal pipe that is in fluid communication with a delivery line through an inlet of the process equipment. The spray arm provides access from the delivery line to the spray device for the multiple phase flow or single phase flow. The spray device connects with the spray arm. The spray device includes open surface area. The open surface area provides an exit for the multiple phase flow or single phase flow into the process equipment interior. The amount of the open surface area is sufficient to provide an adequate amount of the liquid phase of the multiple phase composition to contact the interior surface of the process equipment. The open surface area can include any shapes or variation of shapes sufficient to provide the liquid phase of the multiple phase composition to contact the interior surface of the process equipment. The process equipment can include more than one delivery head within the interior of the process equipment.

Generally, all of the CIP equipment included in a particular processing line and/or production line is not treated at the same time. However, the treating composition can be directed, for example, by valves or valve manifolds, to certain regions of the processing and/or production line. The CIP equipment that is being treated is included in a circuit that includes the CIP system. For example, the CIP system can be connected to a storage tank of the CIP equipment via delivery lines creating a circuit. The CIP equipment within the circuit is then treated. Therefore, the treating composition is only allowed to travel within that circuit, i.e. only that region of the entire processing and/or production line within the circuit. A single CIP system can be used to treat multiple circuits within the entire processing and/or production line. The circuits can include multiple process and flow equipment of the CIP equipment. For example, one circuit can include two storage tanks.

The reference to conventional or single-phase flow generally refers to the presence of a single, liquid phase. It should be understood that the references to multiple phase flow and single-phase flow are not meant to exclude the presence of solids, such as debris, within the combination of liquid phase and gaseous phase or within the single, liquid phase. Multiple phase flow refers to delivery of a multiple phase composition comprising a liquid phase and a gaseous phase through a conduit. The gaseous phase is used to deliver the liquid phase. In general, multiple phase flow can be used to provide advantages compared with conventional, liquid flow. It should be understood that the reference to conventional, liquid flow refers to the general absence of a gaseous phase that suspends and transports a liquid phase. Multiple phase flow in the context of treating CIP equipment refers to a system that utilizes a gaseous phase to deliver or carry a liquid to the interior surface of the CIP equipment.

Multiple phase flow refers to the generally concurrent delivery of a liquid phase and a gaseous phase through a conduit. It should be understood that multiple phase flow refers to a composition that contains a liquid phase and a gaseous phase. In general, multiple phase flow refers to a condition where the liquid phase is distributed or delivered by the gaseous phase. It should be understood that the phrase "generally concurrent delivery" refers to a generally steady state operation and is not intended to reflect a condition resulting from a transient start up of a conventional, liquid flow where there may be some initial mixing of gas with a liquid phase as a result of air being present in the lines, and is not intended to reflect a condition where there may be incidental bubbles present in a conventional, liquid flow.

Multiple phase flow can be used to provide advantages compared with liquid flow. It should be understood that the reference to liquid flow refers to the general absence of a gaseous phase that suspends and transports a liquid phase. Compared to liquid flow treating, multiple phase flow can be used to deliver a higher concentration of chemical agent to a surface to increase the efficacy of the chemical agent. In many applications, it is expected that it would be too costly to use a highly concentrated chemical agent in liquid flow compared with multiple phase flow to deliver the same concentration of chemical agent to a surface. It is expected that multiple phase flow can deliver a highly concentrated chemical to a surface without the waste associated with liquid flow. As a result, certain advantages resulting from the use of highly concentrated chemicals can be realized using multiple phase flow compared with liquid flow. In addition, by using the same amount of chemicals and/or active ingredients, a higher chemical concentration can be provided using multiple phase flow than liquid flow because the gaseous phase is the carrier or diluent in the multiple phase flow whereas water is typically the carrier or diluent in liquid flow. It is expected that multiple phase flow can use less chemistry and/or active ingredients than liquid flow because water is not the primary carrier for the concentrate. By using more concentrated chemistry, it is expected that multiple phase flow can provide a desired effect in less time and/or provide an enhanced effect compared with liquid flow. By treating (such as, cleaning) faster, it is possible to increase the production rate by decreasing the down time of the circuit. It is believed that multiple phase flow can provide an overall reduction in the amount of chemistry and/or active ingredients and water. Multiple phase flow can be utilized to provide a pretreatment step that is generally not economically available for liquid flow.

It should be understood that the use of the phrases liquid flow, single phase flow, and multiple phase flow are not intended to exclude the presence of solids that may be present intentionally and/or as a result of debris that may become a part of the system. In addition, liquid flow can be referred to as flooded flow, and multiple phase flow can be referred to as non-flooded flow.

Now referring to FIG. 1, an exemplary circuit is shown at reference number 100. The circuit is only a portion of an entire processing and/or production line. The circuit 100 includes a multiple phase CIP system 112 and CIP equipment.

The CIP equipment includes delivery lines 104, transfer station 200, valves 204 and 212, and storage tank 108. Within the storage tank 108 are two delivery heads 152. The delivery heads 152 include a spray arm 144 and a spray device 148. The storage tank 108 includes an interior tank surface 164. The interior tank surface 164 surrounds or encloses the tank interior 160. The storage tank 108 includes two cleaning inlets 140 that allow fluid communication between the delivery lines 104 and the delivery head 152. Transfer station 200 directs the multiple phase flow, which is illustrated by the double lines of the delivery lines 104, to the storage tank 108. The storage tank 108 includes a tank outlet 156. The outlet 156 provides an exit for the liquid phase out of the storage tank 108. Valve 204 directs the liquid phase exiting the storage tank either to the drain via exit port 240 or back to the multiple phase CIP system 112 using return pump 168.

The multiple phase CIP system 112 includes a CIP fresh treatment tank 120, a CIP recovery tank 124, an injection port 128, a forced air source 116, valves 136, 208, 220, 228, and 216, a return pump 168, a low volume pump 212, and a high volume pump 132. The high volume pump 132 is used to provide the single phase liquid flow. When desired, the low volume pump 212 is used to provide a sufficient amount of liquid phase to adequately treat the surface of the storage tank 108 using a multiple phase composition. Valve 220 directs flow of the liquid phase to the appropriate pump 132 or 212 depending on whether multiple phase flow or single phase flow is desired. It should be understood that FIG. 1 is only an exemplary embodiment and that the multiple phase CIP system does not have to include both pumps. The return pump 168 pumps the liquid phase to the CIP recovery tank 124, the CIP fresh treatment tank 120, or both. Valves 136 determine where the liquid phase is directed to by the return pump 168.

The liquid phase is provided to the injection port 128 by the use of either the high volume pump 132 or the low volume pump 212. Valve 228 directs the flow of the liquid phase to the injection port 128.

The forced air source 116 provides the gaseous phase for the multiple phase composition. The gaseous phase is directed to the injection port 128 via delivery lines 104. The multiple phase composition exists after the liquid phase is injected through the injection port 128 into the gaseous phase. The multiple phase composition is then directed to the storage tank 108 by valve 212 and transfer station 200. The delivery lines 104 transport the gaseous phase, the liquid phase, and the multiple phase composition.

Figure 2:
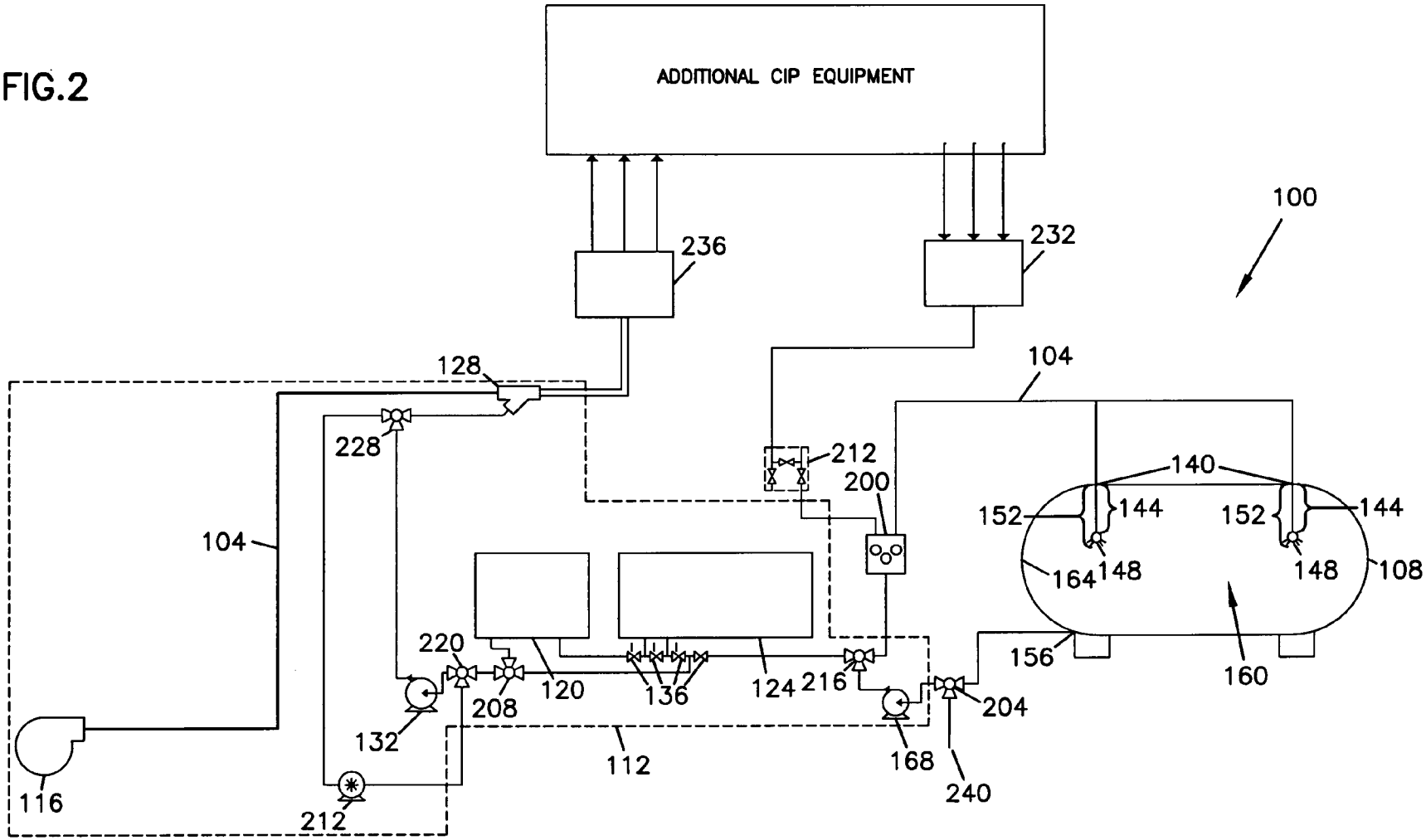
FIG. 2 is a diagram illustrating that the multiple phase CIP system is capable of treating additional CIP equipment within the entire processing and/or production line.

FIG. 2 illustrates an exemplary embodiment of how the multiple phase CIP system 112 treats additional CIP equipment of the entire processing and/or production lines. The multiple phase composition is directed to another circuit within the entire processing line. Valve manifold 236 directs the multiple phase composition exiting the injection port 128 to treat other CIP equipment. Valve manifold 232, valves 212 and 216 along with transfer station 200 direct the liquid phase back to the multiple phase CIP system 112.

Figure 3:
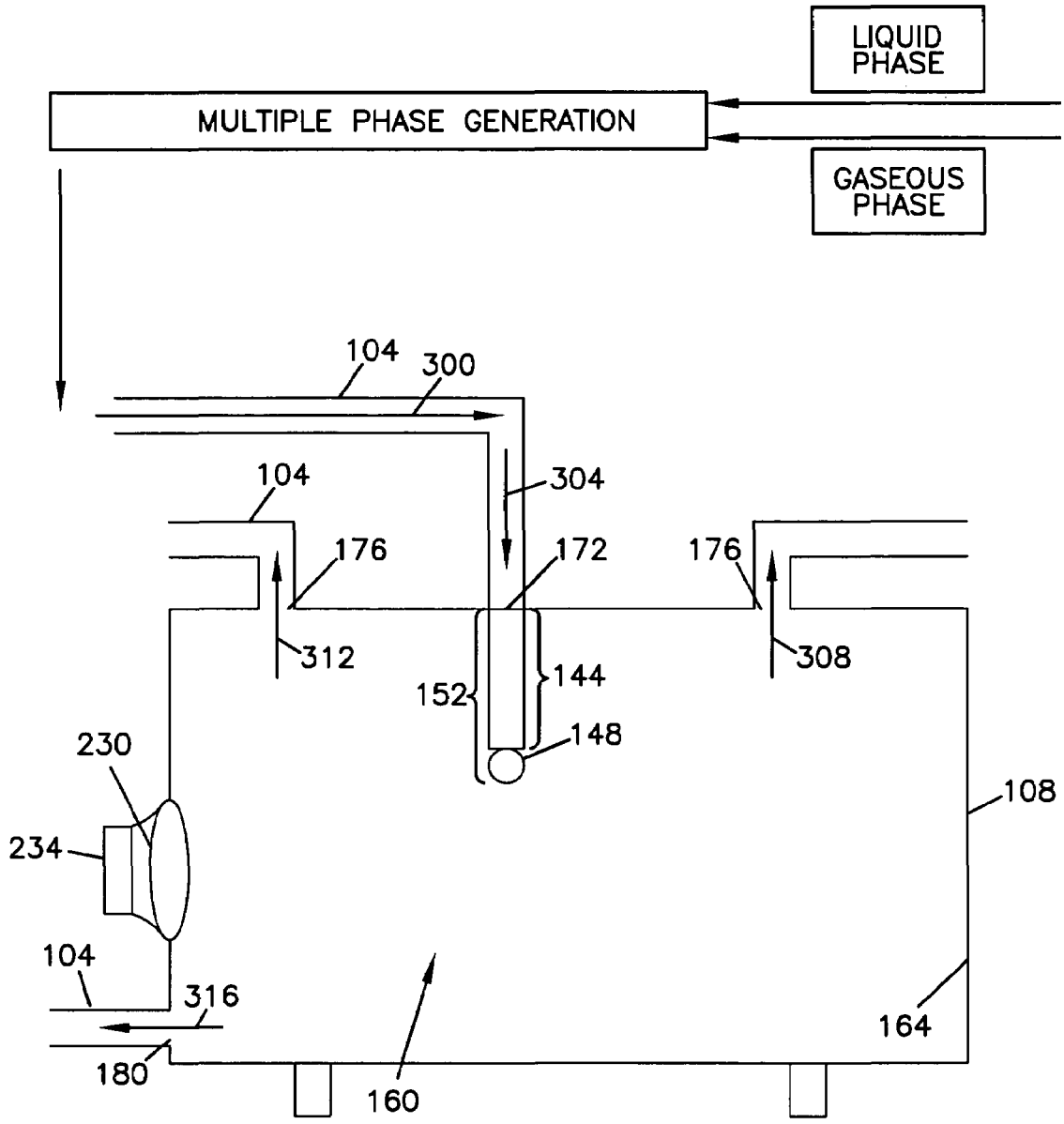
FIG. 3 is a diagram illustrating a storage tank that is treated using a multiple phase composition.

FIG. 3 depicts an exemplary storage tank 108 that can be treated according to the present invention. The storage tank 108 includes a tank interior 160 that is surrounded or enclosed by an interior tank surface 164. The multiple phase composition provided by a multiple phase CIP system is delivered to the storage tank 108 via delivery lines 104. Arrows 300 and 304 indicate the direction of flow of the multiple phase composition. The multiple phase composition enters the storage tank 108 through cleaning inlet 172. The delivery lines 104 are in fluid communication with the delivery head 152. The delivery head 152 includes a spray arm 144 and a spray device 148. The delivery head 152 is designed to provide a sufficient amount of liquid phase to the interior tank surface 164 of the storage tank 108. Storage tank 108 includes two filling inlets 176. The filling inlets 176 provide an opening, which allows the storage tank 108 to be filled by the desired material. The filling inlets 176 also provide an escape for the gaseous phase of the multiple phase composition. Arrows 308 and 312 indicate the direction of flow of the gaseous phase. Storage tank 108 includes a manhole 230 and an outlet 180. The manhole 230 allows access for a person to the tank interior 160. Outlet 180 provides an exit for the liquid phase or any other material that may be within the storage tank 108. Arrow 316 indicates the direction of flow of the material out of storage tank 108.

The storage tank 108 can include a demister cartridge 234. A demister cartridge 234 can be placed over or cover any inlet or outlet of the storage tank 108. The exemplary demister cartridge 234 illustrated in FIG. 3 is placed over manhole 230. The demister cartridge 234 includes a housing that encloses a pad or insert that is capable of trapping a liquid and letting gas escape. The demister cartridge 234 traps liquid so that the liquid may not escape, but allows the gas phase of the multiple phase composition to exit. The demister can be placed over, placed within, or cover any exit or inlet.

The delivery head 152 is provided within the tank 108. The delivery head 152 is designed to sufficiently convey the multiple phase flow through the delivery head 152. A majority of the multiple phase flow is delivered by the spray device 148. It is desirable to have the liquid phase of the multiple phase flow provide an effective liquid layer on the interior tank surface 164 for treating the interior tank surface 164. The liquid phase can be provided on the interior tank surface 164 as a mist or stream. A mist comprises small droplets of water. A stream comprises a constant flow of liquid toward the interior tank surface 164. As the liquid phase contacts or impinges the interior tank surface 164 as a stream, it delivers a shear stress, which can deliver a force sufficient to dislodge debris from the interior tank surface 164. In addition, treatment of the interior tank surface 164 occurs as the liquid phase cascades down and remains on the interior tank surface 164. The amount of time allowed for the liquid phase to remain on the interior tank surface is sufficient to achieve the desired treatment. Exemplary descriptions and listings of delivery heads are disclosed in U.S. patent application Ser. No. 10/786,237.

A general advantage to using multiple phase flow for treating CIP equipment is the ability to deliver a high concentration of a chemical to the interior surface of the CIP equipment. In conventional techniques for treating CIP equipment that utilize a single phase flow of liquid, it is often not possible to achieve the concentration levels that can be achieved by multiple phase flow. In addition, if it is possible to achieve the high concentration levels in single phase flow, it is expected that the cost may be undesirable because of the large amounts of chemicals needed. When treating CIP equipment using multiple phase flow, it is desirable to provide a sufficient amount of liquid phase so that the interior tank surface is adequately contacted by the liquid phase of the multiple phase composition.

Multiple Phase Treating Composition

The multiple phase treatment composition refers to the composition that includes a gaseous phase and a liquid phase, and wherein the gaseous phase is provided for delivery of the liquid phase to a surface. The multiple phase treatment composition can additionally include a solid phase that is provided within the liquid phase, within the gaseous phase, or within a combination of the liquid phase and the gaseous phase. The multiple phase treatment composition can be referred to as the composition in the context of a multiple phase flow system.

The gaseous phase can include air, carbon dioxide, ozone, nitrogen, water, etc. In most applications, it is expected that the gaseous phase will include air. In addition, it is expected that the gaseous phase will be purified in order to remove contaminants such as particulates, bacteria, oil, etc. In addition, it is expected that mixtures of gases can be used. For example, it may be advantageous to use a mixture of air and carbon dioxide and/or ozone. The liquid phase and/or solid phase can include any components that would provide treating by, for example, flushing, rinsing, pretreating, cleaning, or sanitizing when applied to a surface. In addition, the liquid phase could be aqueous or non-aqueous in nature. The solid phase could contain an aqueous or non-aqueous component.

The gaseous phase should have a sufficient velocity to provide adequate coverage of liquid phase to the surface of the CIP equipment for a desired treatment. The gaseous velocity, pressure, and volume can be selected depending on the properties of the CIP equipment to be treated including size of the process equipment, distance traveled in the flow equipment, soil to be removed, and depending on the gaseous composition and the liquid composition being transported. In general, it is desirable for the gaseous velocity, pressure, and volume to be sufficient to transport the liquid phase as a multiple phase composition. That is, it is generally desirable to keep the liquid phase suspended in the gaseous phase to provide desired coverage for application of the liquid phase to the surface to be treated. In addition, it is expected that a gaseous velocity, pressure, and volume that is too high may adversely affect delivering the liquid phase to the surface to be treated.

One skilled in the art would understand that the gas to liquid volume ratio can be controlled to provide adequate delivery of the treatment composition.

The treatment composition can include a surfactant or surfactant mixture that can include at least one of water-soluble or water dispersible nonionic, semi-polar nonionic, anionic, cationic, amphoteric, or zwitterionic surface-active agents, or any combinations or mixtures thereof. The particular surfactant or surfactant mixture chosen for treating the CIP equipment can depend on a number of factors including tendency to foam or not foam, usefulness at the use pH, usefulness at the use temperature, and soil type.

A listing of the classes and species of surfactants useful herein appears in U.S. Pat. No. 3,664,961 issued May 23, 1972, to Norris, and U.S. patent application Ser. No. 10/786,238, the disclosures being incorporated herein by reference.

Anionic Surfactants

It is expected that anionic surfactants can be useful according to the invention. Anionic surfactants are surface active substances having a negative charge on the hydrophobe or have a hydrophobic section that carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

Anionics are very useful additives to preferred compositions of the present invention. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia", *Cosmetics & Toiletries*, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Nonionic Surfactant

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water-soluble compound having the desired degree of balance between hydrophilic and hydrophobic properties. Useful nonionic surfactants in the present invention include:

1. Block polyoxypropylene-polyoxyethylene polymeric compounds such as Pluronic® and Tetronic® manufactured by BASF Corp.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide such as Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide such as Neodol® manufactured by Shell Chemical Co. and Alfonic® manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide such as Nopalcol® manufactured by Henkel Corporation and Lipopeg® manufactured by Lipo Chemicals, Inc.

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule such as Pluronic® R surfactants manufactured by BASF.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof.

7. The alkylphenoxypolyethoxyalkanols of U.S. Pat. No. 2,903,486 issued Sep. 8, 1959 to Brown et al.

8. Polyhydroxy fatty acid amide surfactants.

9. The alkyl ethoxylate condensation products of aliphatic alcohols

10. The ethoxylated C6-C18 fatty alcohols and C6-C18 mixed ethoxylated and propoxylated fatty alcohols.

11. Suitable nonionic alkylpolysaccharide surfactants, particularly for use in the present compositions include those disclosed in U.S. Pat. No. 4,565,647, Llenado, issued Jan. 21, 1986.

12. Fatty acid amide surfactants.

13. A useful class of non-ionic surfactants include the class defined as alkoxylated amines or, most particularly, alcohol alkoxylated/aminated/alkoxylated surfactants.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of nonionic surfactant useful in compositions of the present invention. The semi-polar nonionic surfactants include the amine oxides, phosphine oxides, sulfoxides and their alkoxylated derivatives.

Cationic Surfactants

Cationic surfactants may be useful according to the present invention. Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y− and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants can refer to compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like. The disclosures of cationic surfactants in the above references are incorporated herein by reference.

Amphoteric Surfactants

Amphoteric surfactants can be useful according to the present invention. Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia", *Cosmetics & Toiletries*, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). The disclosures of amphoteric surfactants in the above-identified references are incorporated herein by reference.

Zwitterionic Surfactants

It is expected that zwitterionic surfactants can be used according to the invention. Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). The disclosures of zwitterionic surfactants in the above references are incorporated herein by reference.

Surfactant Compositions

The surfactants described hereinabove can be used singly or in combination in the practice and utility of the present invention. In particular, the nonionics and anionics can be used in combination. The semi-polar nonionic, cationic, amphoteric and zwitterionic surfactants can be employed in combination with nonionics or anionics. The above examples are merely specific illustrations of the numerous surfactants, which can find application within the scope of this invention. It should be understood that the selection of particular surfactants or combinations of surfactants can be based on a number of factors, including the desired soil that is encountered on the surface being treated and the intended environmental conditions including temperature and pH. Accordingly, one should understand that surfactants that may useful in the treatment of particular soils, may not be useful in the treatment of different soils. In addition, the level and degree of foaming under the conditions of use and in subsequent recovery of the composition can be a factor for selecting particular surfactants and mixtures of surfactants. For examples, in certain applications it may be desirable to minimize foaming and, as a result, one would select a surfactant or mixture of surfactants that provides reduced foaming. In addition, it may be desirable to select a surfactant or a mixture of surfactants that exhibits a foam that breaks down relatively quickly so that the composition can be recovered and reused with an acceptable amount of down time. In addition, the surfactant or mixture of surfactants can be selected depending upon the particular soil that is encountered.

It should be understood that the treatment composition need not include a surfactant or a surfactant mixture, and can include other components. In addition, the treatment composition can include a surfactant or surfactant mixture in combination with other components. Exemplary other components that can be provided within the treatment composition include builders, water conditioning agents, nonaqueous components, adjuvants, enzymes, pH adjusting agents, and bleaching agent.

Builders

Builders are substances that augment the detersive effects of detergents or surfactants and supply alkalinity to the cleaning solution. Builders have the detersive properties of promoting the separation of soil from surfaces and keeping detached soil suspended in the detersive solution to retard redeposition. Builders may of themselves be precipitating, sequestrating or dispersing agents for water hardness control; however, the builder effect is independent of its water conditioning properties. Although there is functional overlap, builders and water conditioning agents having utility in this invention will be treated separately.

Builders and builder salts can be inorganic or organic in nature and can be selected from a wide variety of detersive, water soluble, alkaline compounds known in the art. Water soluble inorganic alkaline builder salts which can be used alone in the present invention or in admixture with other builders include, but are not limited to, alkali metal or ammonia or substituted ammonium salts of carbonates, silicates, phosphates and polyphosphates, and borates. Water soluble organic alkaline builders which are useful in the present invention include alkanolamines and cyclic amines.

Water Conditioning Agent

Water conditioning agents function to inactivate water hardness and prevent calcium and magnesium ions from interacting with soils, surfactants, carbonate and hydroxide. Water conditioning agents therefore improve detergency and prevent long term effects such as insoluble soil redepositions, mineral scales and mixtures thereof. Water conditioning can be achieved by different mechanisms including sequestration, precipitation, ion-exchange and dispersion (threshold effect).

The water conditioning agents which can be used include inorganic water soluble water conditioning agents, inorganic water insoluble water conditioning agents, organic water soluble conditioning agents, and organic water insoluble water conditioning agents. Exemplary inorganic water soluble water conditioning agents include all physical forms of alkali metal, ammonium and substituted ammonium salts of carbonate, bicarbonate and sesquicarbonate; pyrophrophates, and condensed polyphosphates such as tripolyphosphate, trimetaphosphate and ring open derivatives; and, glassy polymeric metaphosphates of general structure Mn+2PnO3n+1 having a degree of polymerization n of from about 6 to about 21 in anhydrous or hydrated forms; and, mixtures thereof. Exemplary inorganic water insoluble water conditioning agents include aluminosilicate builders. Exemplary water soluble water conditioning agents include aminpolyacetates, polyphosphonates, aminopolyphosphonates, short chain carboxylates and polycarboxylates.

Non-Aqueous Components

These include the higher glycols, polyglycols, polyoxides, glycol ethers, aliphatic hydrocarbons, aromatic hydrocarbons, alcohols, etc.

Optional Adjuvants

In addition, various other additives or adjuvants may be present in compositions of the present invention to provide additional desired properties, either of form, functional or aesthetic nature, for example:

a) Solubilizing intermediaries called hydrotropes can be present in the compositions of the invention of such as xylene-, toluene-, or cumene sulfonate; or n-octane sulfonate; or their sodium-, potassium- or ammonium salts or as salts of organic ammonium bases. Also commonly used are polyols containing only carbon, hydrogen and oxygen atoms. They preferably contain from about 2 to about 6 carbon atoms and from about 2 to about 6 hydroxy groups. Examples include 1,2-propanediol, 1,2-butanediol, hexylene glycol, glycerol, sorbitol, mannitol, and glucose.

b) Nonaqueous liquid carrier or solvents can be used for varying compositions of the present invention.

c) Viscosity modifiers may be added to the invention. These may include natural polysaccharides such as xanthan gum, carrageenan and the like; or cellulosic type thickeners such as carboxymethyl cellulose, and hydroxymethyl-, hydroxyethyl-, and hydroxypropyl cellulose; or, polycarboxylate thickeners such as high molecular weight polyacrylates or carboxyvinyl polymers and copolymers; or, naturally occurring and synthetic clays; and finely divided fumed or precipitated silica, to list a few.

d) Solidifiers are necessary to prepare solid form compositions of the invention. These could include any organic or inorganic solid compound having a neutral inert character or making a functional, stabilizing or detersive contribution to the intended embodiment. Examples are polyethylene glycols or polypropylene glycols having molecular weight of from about 1,400 to about 30,000; and urea.

A wide variety of other ingredients useful in detergent compositions can be included in the compositions hereof, including other active ingredients, carriers, draining promoting agents, manufacturing processing aids, corrosion inhibitors, antimicrobial preserving agents, buffers, tracers, inert fillers, dyes, etc.

Enzymes

Enzymes can be used to catalyze and facilitate organic and inorganic reactions. It is well known, for example, that enzymes are used in metabolic reactions occurring in animal and plant life.

The enzymes that can be used according to the invention include simple proteins or conjugated proteins produced by living organisms and functioning as biochemical catalysts which, in detergent technology, degrade or alter one or more types of soil residues encountered on food process equipment surfaces thus removing the soil or making the soil more removable by the detergent-cleaning system. Both degradation and alteration of soil residues improve detergency by reducing the physicochemical forces, which bind the soil to the surface being cleaned, i.e. the soil becomes more water-soluble. The enzyme may be functional in either the acidic, neutral or alkaline pH range.

As defined in the art, enzymes are referred to as simple proteins when they require only their protein structures for catalytic activity. Enzymes are described as conjugated proteins if they require a non-protein component for activity, termed cofactor, which is a metal or an organic biomolecule often referred to as a coenzyme. Cofactors are not involved in the catalytic events of enzyme function. Rather, their role seems to be one of maintaining the enzyme in an active configuration. As used herein, enzyme activity refers to the ability of an enzyme to perform the desired catalytic function of soil degradation or alteration; and, enzyme stability pertains to the ability of an enzyme to remain or to be maintained in the active state.

Enzymes are extremely effective catalysts. In practice, very small amounts will accelerate the rate of soil degradation and soil alteration reactions without themselves being consumed in the process. Enzymes also have substrate (soil) specificity which determines the breadth of its catalytic effect. Some enzymes interact with only one specific substrate molecule (absolute specificity); whereas, other enzymes have broad specificity and catalyze reactions on a family of structurally similar molecules (group specificity).

Enzymes exhibit catalytic activity by virtue of three general characteristics: the formation of a noncovalent complex with the substrate, substrate specificity, and catalytic rate. Many compounds may bind to an enzyme, but only certain types will lead to subsequent reaction. The later are called substrates and satisfy the particular enzyme specificity requirement. Materials that bind but do not thereupon chemically react can affect the enzymatic reaction either in a positive or negative way. For example, unreacted species called inhibitors interrupt enzymatic activity.

Several enzymes may fit into more than one class. A valuable reference on enzymes is "Industrial Enzymes", Scott, D., in *Kirk-Othmer Encyclopedia of Chemical Technology,* 3rd Edition, (editors Grayson, M. and EcKroth, D.) Vol. 9, pp. 173-224, John Wiley & Sons, New York, 1980. The disclosure of this reference relating to enzymes is incorporated herein by reference.

Proteases, a sub-class of hydrolases, are further divided into three distinct subgroups which are grouped by the pH optima (i.e. optimum enzyme activity over a certain pH range). These three subgroups are the alkaline, neutral and acids proteases. These proteases can be derived from vegetable, animal or microorganism origin; but, preferably are of the latter origin which includes yeasts, molds and bacteria. Examples of suitable commercially available alkaline proteases are Alcalase®, Savinase®, and Esperase®—all of Novo Industri AS, Denmark; Purafect® of Genencor International; Maxacal®, Maxapem® and Maxatase®—all of Gist-Brocase International NV, Netherlands; Optimase® and Opticlean® of Solvay Enzymes, USA and so on.

Commercial alkaline proteases are obtainable in liquid or dried form, are sold as raw aqueous solutions or in assorted purified, processed and compounded forms, and are comprised of about 2% to about 80% by weight active enzyme generally in combination with stabilizers, buffers, cofactors, impurities and inert vehicles. The actual active enzyme content depends upon the method of manufacture and is not critical, assuming the detergent solution has the desired enzymatic activity. The particular enzyme chosen for use in the process and products of this invention depends upon the conditions of final utility, including the physical product form, use pH, use temperature, and soil types to be degraded or altered. The enzyme can be chosen to provide optimum activity and stability for any given set of utility conditions.

Naturally, mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme.

In addition to proteases, it is also to be understood, and one skilled in the art will see from the above enumeration, that other enzymes which are well known in the art may also be used with the composition of the invention. Included are other hydrolases such as esterases, carboxylases and the like; and, other enzyme classes.

Further, in order to enhance its stability, the enzyme or enzyme admixture may be incorporated into various non-liquid embodiments of the present invention as a coated, encapsulated, agglomerated, prilled or marumerized form. Also, to enhance stability, the enzyme or enzyme admixture may be incorporated into various non-aqueous embodiments such as propylene glycol, glycerin, etc.

pH Adjusting Agents pH adjusting agents may be useful according to the present invention. The pH of the treatment composition can be adjusted by the introduction of a pH adjusting agent that can be an acid or a base.

When the pH adjusting agent is used to increase the pH, it can be referred to as an alkaline agent. Exemplary alkaline agents include alkali metal hydroxides, such as sodium hydroxide, potassium hydroxide, and mixtures thereof, alkali metal silicates such as sodium metal silicate, alkaline metal carbonates, alkaline metal bicarbonates, alkaline metal sesquicarbonates, and alkaline metal borates. Sodium hydroxide can be used in an aqueous solution and in a variety of solid forms in varying particle sizes. The carbonate and borate sources are typically used in place of alkaline metal hydroxide when a lower pH is desired.

When the pH adjusting agent is used to lower the pH, it can be referred to as an acidifying agent. Exemplary acidifying agents include inorganic acids, organic acids, and mixtures of inorganic acids and organic acids. Exemplary inorganic acids that can be used include mineral acids such as sulfuric acid, nitric acid, hydrochloric acid, and phosphoric acid. Exemplary organic acids that can be used include carboxylic acids including monocarboxylic acids and polycarboxcylic acids such as dicarboxcylic acids. Exemplary carboxylic acids include aliphatic and aromatic carboxylic acids. Exemplary aliphatic carboxylic acids include acetic acid, formic acid, halogen-containing carboxylic acids such as chloroacetic carboxylic acid, and modified carboxylic acids containing side groups such —OH, —R, —OR, $-(EO)_x$, $—(PO)_x$, $—NH_2$, and $—NO_2$ wherein R is a $C_1$ to $C_{10}$ alkyl group. Exemplary aromatic carboxylic acids include benzoic carboxylic acid, salicylic carboxylic acid, and aromatic carboxylic acid modified to include as a side group at least one of halogen, —OH, —R, —OR, $-(EO)_x$, $—(PO)_x$, $—NH_2$, and $—NO_2$ wherein R is a $C_1$ to $C_{10}$ alkyl group. Additional exemplary organic acids include oxalic acid, phthlaic acid, sebacic acid, adipic acid, citric acid, maleic acid, and modified forms thereof containing side groups including halogen, —OH, —R, —OR, $-(EO)_x$, $—(PO)_x$, $—NH_2$, and $—NO_2$ wherein R is a $C_1$ to $C_{10}$ alkyl group. It should be understood that the subscript "x" refers to repeating units. Additional exemplary organic acids include fatty acids such as aliphatic fatty acids and aromatic fatty acids. Exemplary aliphatic fatty acids include oleic acid, palmitic acid, stearic acid, $C_3$-$C_{26}$ fatty acids that may be saturated or unsaturated, and sulfonated forms of fatty acids. An exemplary aromatic fatty acid includes phenylstearic acid. Additional acids that can be used include peroxycarboxylic acid such as peroxyacetic acid, and phthalimidopercarboxylic acids. Additional acidic pH adjusting agents include carbon dioxide and ozone.

Bleaching Agents

Bleaching agents may be useful according to the present invention. Bleaching agents include bleaching compounds capable of liberating an active halogen species, such as $Cl_2$, $Br_2$, $—OCl^-$ and/or $—OBr^-$, under conditions typically encountered during the treating process. Suitable bleaching agents for use in the present treating compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosures of which are incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like.

CIP Equipment Treating Programs

Various different treatment programs can be used to treat CIP equipment according to the invention. It is expected that commonly available CIP equipment treating programs can be altered to include one or more treatments using multiple phase flow. For example, the application of a cleaning composition in a commonly available CIP equipment treating program can be replaced with a multiple phase flow cleaning composition. In addition, the sanitizing step that may be found in commonly available CIP equipment treating programs can be replaced with multiple phase flow for delivering sanitizing compositions. Furthermore, the application of a rinsing composition in a commonly available CIP equipment treating program can be replaced with a multiple phase flow cleaning composition. An additional pretreatment step that utilizes multiple phase flow can be added to a CIP equipment treating program to enhance the treatment of the surface of the CIP equipment. It should be understood that multiple phase flow can be used in combination with other steps that involve liquid flow. And a treatment process or program that includes at least one multiple phase flow step and other liquid flow steps can be characterized as a hybrid treatment method.

The method for treating CIP equipment can include a plurality of steps. A first step can be referred to as a product removal step or displacement where product is removed from the CIP equipment. The product can be effectively recovered and used as opposed to discharging as plant effluent. In general, the product removal step can be characterized as an exchange step where water, gas, or multiple phase flow displaces the product from the CIP equipment. The use of multiple phase flow is a surprisingly effective method for displacing and recovering product with minimal water consumption as compared to a conventional flooded liquid flow method. The product removal step can last as long as it takes to remove and recover product from the CIP equipment. In general, it is expected that the product removal step will take at least a minute for most CIP equipment.

Another step often used can be referred to as a pre-rinse step. In general, water and/or an alkaline solution can be circulated in the CIP equipment to remove gross soils. Multiple phase flow offers an alternative pre-rinse step that utilizes less water than liquid flow while still removing much of the gross soils.

If the displacement and/or pre-rinse steps are used with liquid flow (that is, water, for example, is used to displace product and rinse the CIP equipment), multiple phase flow can be used to remove the liquid from the CIP equipment. Accordingly, multiple phase flow can provide for removal of product, loose soils, and excess liquid from the CIP equipment. For large scale CIP equipment, it is expected that steps of product recovery and pre-rinse using multiple phase flow containing air and water will take at least about 2 minutes, and will take less than about 60 minutes. It should be understood that a large scale CIP equipment refers to an industrial system.

In addition to product displacement and pre-rinse steps, multiple phase flow can be used to provide cleaning, sanitizing, rinsing, and/or pre-treatment. It should be understood that a method of treating CIP equipment according to the invention can include multiple phase flow in any of the above-identified steps and can include a combination of multiple phase flow and conventional, liquid flow.

During a multiple phase flow step when it is intended to contact the CIP equipment surface with a liquid phase, it is generally desirable to run the multiple phase flow for a sufficient amount of time to adequately contact the CIP equipment surface. For large scale CIP equipment, it is expected that the multiple phase flow will last at least about 3 minutes in order to provide sufficient contacting of the CIP equipment surface. In addition, the multiple phase flow can be provided as a single pass or as a recirculation. When referring to single pass or recirculation, it should be understood that reference is being made to the liquid phase. That is, if the liquid phase passes through the CIP equipment and collects in a tank for disposal or subsequent use during a later step, the step can be referred to as single pass. When the liquid phase is collected and recycled during that step, the step can be referred to as a recirculation. It is expected that certain types of chemistry may be difficult to recirculate because of foaming. Accordingly, it may be necessary to use those chemistries in a single pass operation. Recirculation is desirable in order to conserve chemicals. It should be understood that chemicals can be conserved by recycling. That is, chemicals can be recovered and used in a subsequent step.

After the liquid phase has been delivered to the CIP equipment surface, the multiple phase flow can be turned off and the chemistry can be allowed to interact with the surface and/or the soil on the surface in a soaking step. It should be understood that this soak step can be provided as an optional step. If the multiple phase flow is provided as a recirculation flow, it may be unnecessary to turn off the multiple phase flow to allow the chemistry to interact with the soil.

It is generally desirable to minimize the soak step in order to minimize the down time for the CIP equipment. When a soak step is utilized, it can be utilized for a sufficient time to adequately treat the CIP equipment. It is expected that by providing chemicals on the surface of the CIP equipment having a higher concentration compared with conventional, liquid delivery of chemicals, the interaction between the chemistry and the soil can take place at a more rapid rate.

After a liquid phase has been applied to the surface of the CIP equipment as a result of multiple phase flow, the CIP equipment can be flooded with liquid such as water, and the water can be recirculated through the CIP equipment. If the liquid phase applied during the multiple phase flow is relatively highly concentrated, it is expected that dilution with water to provide liquid flow will result in a decrease in concentration. Accordingly, one option for practicing the invention includes applying a liquid phase at a relatively high concentration in order to achieve a desired effect as a result of the high concentration, and then introducing a liquid such as water to provide a flooded system that can be recirculated to provide conventional, flooded cleaning. The concentration of the chemical agent during the flooded treatment can be the same as that encountered conventionally. Furthermore, the treatment system can be designed to provide less down time compared with a conventional, flooded system.

It should be understood that while one option is to deliver the liquid phase by multiple phase flow, optionally let the liquid phase soak on the surface of the CIP equipment, and flood the system with water to provide a flooded, liquid recirculation, an alternative approach is to provide multiple phase recirculation. In addition, multiple phase rinse can be provided where the treatment composition is rinsed from the surface after it has completed its intended effect, such as cleaning or sanitizing.

The flooded procedure can be continued for a length of time sufficient to move soil off the CIP equipment surface. When the process includes a flooded recirculation step, it is expected that the flooded recirculation step will take place for a sufficient amount of time to adequately treat the CIP equipment.

A flooded/conventional flow or multiple phase flow rinse step can be provided to help remove the chemistry out of the CIP equipment.

Several chemistry treatment cycles can be repeated for acid treatment, alkaline treatment, and neutral treatment. In general, the various treatments can be provided with or without an enzyme.

The liquid component of the multiple phase invention can be provided as an alkaline treatment, an acidic treatment, a neutral treatment, a solvent treatment and/or as an enzymatic treatment.

The multiple phase treating composition can be provided having a ratio of the gaseous phase to the liquid phase that is sufficient to deliver a desired concentration of the liquid phase to the CIP equipment surface to provide the desired treatment and/or detersive properties. In general, it is expected that the volumetric ratio of the gaseous phase to the liquid phase will be at least about 100 (100 standard cubic feet per minute gaseous phase to 1 standard cubic foot per minute liquid phase).

By way of example, various compositions can be used in various multiple phase treatment steps. For example, product displacement and/or flushing can be accomplished with air or a mixture of air and water. Rinsing can be accomplished with a mixture of air and water, and can include neutral, acidic, or alkaline solutions. Cleaning can be accomplished using air and a cleaning composition that can include alkaline, acid, enzymes, non-aqueous components, and/or surfactants. Sanitizing can be accomplished with air and a composition that includes chlorine, acids, peracids, and/or reducing compositions. Pretreatment can be generally characterized as a prespotting application where a concentrate of a treatment chemical is placed on the interior surface of the CIP equipment. The pretreatment chemical can be any chemical that assists in the removal of soil. Exemplary pretreatment chemicals include soil softening agents, penetrants, alkalinity, and acid. A penetrant is generally considered to be a component that penetrates into the soil and softens the soil for removal. The penetrant can be selected for the particular type of soil expected on the surface of the CIP equipment. In the case of CIP equipment used in the dairy industry, it is expected that the penetrant will be selected to provide for penetration into protein soils.

While a detailed description of the present invention has been provided above, the invention is not limited thereto and modifications will be apparent to those of ordinary skill in the art. The invention is defined by the following claims.

We claim:

1. A method for treating CIP equipment, the method comprising:

(a) treating the CIP equipment with a multiple phase treating composition comprising a treating liquid phase and a treating gaseous phase, wherein the multiple phase treating composition has a volumetric ratio of the treating gaseous phase of 100 cubic feet per minute to the treating liquid phase of 1 cubic foot per minute; and (b) rinsing the CIP equipment with a multiple phase rinsing composition comprising a rinsing liquid phase and a rinsing gaseous phase;

wherein the CIP equipment comprises process equipment comprising at least one of an evaporator, a separator, a fermentation tank, an aging tank, or a storage tank.

2. A method according to claim 1, wherein the process equipment is part of a food industrial plant.

3. A method according to claim 1, wherein the process equipment is part of a beverage industrial plant.

4. A method according to claim 1, wherein the process equipment is part of a pharmaceutical industrial plant.

5. A method according to claim 1, wherein the process equipment is part of a chemical industrial plant.

6. A method according to claim 1, wherein the process equipment is part of a water purification industrial plant.

7. A method according to claim 1, wherein the treating gaseous phase comprises at least one of air, nitrogen, or carbon dioxide.

8. A method according to claim 1, wherein the multiple phase treating composition comprises a sufficient amount of the treating liquid phase to treat the CIP equipment.

9. A method according to claim 1, wherein treating the CIP equipment comprises cleaning.

10. A method according to claim 1, wherein the multiple phase treating composition comprises a sufficient amount of treating gaseous phase to treat the CIP equipment.

11. A method according to claim 1, wherein the method further comprises:

(c) rinsing the CIP equipment with a second multiple phase rinsing composition comprising a second rinsing liquid phase and a second rinsing gaseous phase.

12. A method for treating CIP equipment the method comprising:

(a) treating the CIP equipment with a multiple phase treating composition comprising a treating liquid phase and a treating gaseous phase, wherein the multiple phase treating composition has a volumetric ratio of the treating gaseous phase of 100 cubic feet per minute to the treating liquid phase of 1 cubic foot per minute;

(b) rinsing the CIP equipment with a multiple phase rinsing composition comprising a rinsing liquid phase and a rinsing gaseous phase; and (c) sanitizing the CIP equipment with a multiple phase sanitizing composition comprising a sanitizing liquid phase and a sanitizing gaseous phase;

wherein the CIP equipment comprises process equipment comprising at least one of an evaporator, a separator, a fermentation tank, an airing tank, or a storage tank.

13. A method according to claim 12, wherein the process equipment is part of a food industrial plant.

14. A method according to claim 12, wherein the process equipment is part of a beverage industrial plant.

15. A method according to claim 12, wherein the process equipment is part of a pharmaceutical industrial plant.

16. A method according to claim 12, wherein the process equipment is part of a chemical industrial plant.

17. A method according to claim 12, wherein the process equipment is part of a water purification industrial plant.

18. A method according to claim 12, wherein the treating gaseous phase comprises at least one of air, nitrogen, or carbon dioxide.

19. A method according to claim 12, wherein the multiple phase treating composition comprises a sufficient amount of the treating liquid phase to treat the CIP equipment.

20. A method according to claim 12, wherein treating the CIP equipment comprises cleaning.

21. A method according to claim 12, wherein the multiple phase treating composition comprises a sufficient amount of treating gaseous phase to treat the CIP equipment.

22. A method according to claim 12, wherein the method further comprises:

(c) rinsing the CIP equipment with a second multiple phase rinsing composition comprising a second rinsing liquid phase and a second rinsing gaseous phase.

* * * * *